US011195446B2

(12) United States Patent
Iversen et al.

(10) Patent No.: US 11,195,446 B2
(45) Date of Patent: Dec. 7, 2021

(54) WIDE COLOR GAMUT LED PIXEL WITH SCREEN-DOOR REDUCTION AND HIGH LED SELECTION YIELD

(71) Applicant: IMAX Theatres International Limited, Dublin (IE)

(72) Inventors: Steen Svendstorp Iversen, Dublin (IE); David Morrison Martindale, Oakville (CA)

(73) Assignee: IMAX Theatres International Limited, Dublin (IE)

( * ) Notice: Subject to any disclaimer, the term of this patent is extended or adjusted under 35 U.S.C. 154(b) by 0 days.

(21) Appl. No.: 16/760,999

(22) PCT Filed: Nov. 6, 2018

(86) PCT No.: PCT/IB2018/058719
§ 371 (c)(1),
(2) Date: May 1, 2020

(87) PCT Pub. No.: WO2019/087169
PCT Pub. Date: May 9, 2019

(65) Prior Publication Data

US 2020/0349878 A1 Nov. 5, 2020

Related U.S. Application Data

(60) Provisional application No. 62/581,852, filed on Nov. 6, 2017.

(51) Int. Cl.
*G09G 3/20* (2006.01)
*G09G 3/32* (2016.01)

(52) U.S. Cl.
CPC ..... *G09G 3/2003* (2013.01); *G09G 3/32* (2013.01); *G09G 2300/0452* (2013.01);
(Continued)

(58) Field of Classification Search
CPC ..... G09G 3/2003; G09G 3/32; G09G 2300/0452; G09G 2320/064;
(Continued)

(56) References Cited

U.S. PATENT DOCUMENTS 9,646,528 B2 5/2017 Yata et al.
2016/0163249 A1* 6/2016 Yata ..... G09G 3/2003 345/694

(Continued)

OTHER PUBLICATIONS

International Patent Application No. PCT/IB2018/058719, International Search Report and Written Opinion, dated Feb. 21, 2019, 11 pages.

*Primary Examiner* — Andrew Sasinowski
(74) *Attorney, Agent, or Firm* — Kilpatrick Townsend & Stockton LLP

(57) ABSTRACT

An active display can have an increased color gamut and include a group of LED packets that each form a sub-pixel and that together form a pixel for the display. Each LED packet includes at least a red primary color LED, a greed primary color LED, and a blue primary color LED. Each LED can be associated with an intensity value to control the intensity of primary light outputted by the LED. The group of LED packets can output light in a color gamut of a color space for the active display. Each LED packet of the group of LED packets, individually, is configured to output light in the color gamut of a subset of the color space. The active display can display a visual media presentation to an audience. An increased fraction of LEDs from a production batch can be used in the active display.

25 Claims, 11 Drawing Sheets

(52) U.S. Cl.
CPC ..... *G09G 2320/064* (2013.01); *G09G 2320/0666* (2013.01); *G09G 2320/0693* (2013.01); *G09G 2340/06* (2013.01); *G09G 2370/022* (2013.01)

(58) Field of Classification Search
CPC ... G09G 2320/0666; G09G 2320/0693; G09G 2340/06; G09G 2370/022; G09G 2300/0809; G09G 3/3233
See application file for complete search history.

(56) References Cited

U.S. PATENT DOCUMENTS

| | | | | |
|---|---|---|---|---|
| 2018/0144715 | A1* | 5/2018 | Shigeta | G09G 3/2081 |
| 2018/0219025 | A1* | 8/2018 | Takahashi | G09G 3/3659 |
| 2018/0286339 | A1* | 10/2018 | Koudo | G09G 3/3648 |
| 2019/0057672 | A1* | 2/2019 | Yen | G09G 3/2003 |

* cited by examiner

| LED | R | G | B |
|---|---|---|---|
| 1 | R1 | G2 | B6 |
| 2 | R1 | G3, G4, G5 | B6, B7, B8 |
| 3 | R1 | G3, G4, G5 | B6, B7, B8 |
| 4 | R1 | G6 | B6, B7, B8 |

| Gruppe Group | Cx | Cy | Gruppe Group | Cx | Cy |
|---|---|---|---|---|---|
| red | 0.6892 | 0.292 | 6 | 0.1351 | 0.045 |
| | 0.712 | 0.291 | | 0.1489 | 0.0651 |
| | 0.6801 | 0.324 | | 0.142 | 0.0889 |
| | 0.6551 | 0.325 | | 0.1246 | 0.666 |
| 2 | 0.1347 | 0.7539 | 7 | 0.1309 | 0.052 |
| | 0.1672 | 0.685 | | 0.1464 | 0.0736 |
| | 0.1934 | 0.6911 | | 0.138 | 0.1001 |
| | 0.1654 | 0.7627 | | 0.1193 | 0.0777 |
| 3 | 0.1437 | 0.7597 | 8 | 0.1262 | 0.0606 |
| | 0.1755 | 0.6882 | | 0.1432 | 0.0829 |
| | 0.2027 | 0.6913 | | 0.1342 | 0.114 |
| | 0.1779 | 0.7591 | | 0.1156 | 0.0935 |
| 4 | 0.1601 | 0.7618 | | | |
| | 0.1883 | 0.692 | | | |
| | 0.2165 | 0.6915 | | | |
| | 0.1963 | 0.7532 | | | |
| 5 | 0.1717 | 0.761 | | | |
| | 0.1976 | 0.6925 | | | |
| | 0.2269 | 0.6878 | | | |
| | 0.2083 | 0.7498 | | | |
| 6 | 0.1903 | 0.755 | | | |
| | 0.2121 | 0.6908 | | | |
| | 0.2429 | 0.6811 | | | |
| | 0.2273 | 0.7408 | | | |

| RANGE ID | CENTER WAVELENGTH | ALLOWABLE BIN CODES |
|---|---|---|
| Rs | 619 - 624 nm | RB |
| Rl | 619 - 624 nm | RB |
| Gs | 520 - 527.5 nm | G7, G23 |
| Gl | 530 - 540 nm | G9, G67, Ga |
| Bs | 460 - 467.5 nm | B3, B23 |
| Bl | 470 - 480 nm | B5, B67, B6 |

FIG. 6

| COLOR SPACE IDENTIFIER | PRIMARIES | | | | | | WHITE POINT CALIB. | | | LED ATTENUATIONS | | | | | | | | | | | |
|---|---|---|---|---|---|---|---|---|---|---|---|---|---|---|---|---|---|---|---|---|---|
| | Rx | Ry | Gx | Gy | Bx | By | Ar | Ag | Ab | Ar1 | Ar2 | Ar3 | Ar4 | Ag1 | Ag2 | Ag3 | Ag4 | Bg1 | Bg2 | Bg3 | Bg4 |
| 1 | 0.680 | 0.320 | 0.265 | 0.690 | 0.150 | 0.060 | 53% | 47% | 60% | 23% | 20% | 100% | 15% | 5% | 100% | 20% | 49% | 25% | 34% | 17% | 100% |
| 2 | 0.610 | 0.345 | 0.301 | 0.598 | 0.171 | 0.070 | 34% | 31% | 40% | 89% | 100% | 71% | 80% | 100% | 97% | 63% | 76% | 77% | 85% | 93% | 100% |
| 3 | 0.610 | 0.345 | 0.251 | 0.591 | 0.171 | 0.070 | 34% | 29% | 39% | 89% | 100% | 71% | 85% | 87% | 100% | 45% | 50% | 77% | 85% | 93% | 100% |
| 4 | 0.610 | 0.345 | 0.268 | 0.593 | 0.171 | 0.070 | 34% | 30% | 39% | 89% | 100% | 71% | 100% | 76% | 74% | 56% | 43% | 77% | 85% | 93% | 100% |
| 5 | 0.610 | 0.345 | 0.288 | 0.596 | 9.171 | 0.070 | 35% | 29% | 39% | 89% | 100% | 71% | 82% | 74% | 100% | 45% | 37% | 77% | 85% | 93% | 100% |

FIG. 8

| COLOR SPACE IDENTIFIER | COLOR PRECISION | PIXEL UNIFORMITY |
|---|---|---|
| 1 | 100% | 76% |
| 2 | 100% | 100% |
| 3 | 100% | 96% |
| 4 | 100% | 94% |
| 5 | 99% | 88% |

FIG. 9

WIDE COLOR GAMUT LED PIXEL WITH SCREEN-DOOR REDUCTION AND HIGH LED SELECTION YIELD

CROSS-REFERENCE TO RELATED APPLICATION

This claims the benefit of priority to U.S. Provisional Patent Application No. 62/581,852, titled "Wide Gamut LED Pixel with Screen-Door Reduction and High LED Selection Yield" and filed Nov. 6, 2017, the entirety of which is incorporated herein by reference.

TECHNICAL FIELD

This disclosure relates to active displays for visual presentations. Some examples relate to active displays for theatre presentations of movies and other visual media.

BACKGROUND

Large direct-view light-emitting diode (LED) displays can be used for advertising applications, such as billboards, for presenting text, images, and video. Recently, LED displays have been used in cinemas, presenting potential advantages over light projection systems in image-quality parameters such as brightness, contrast, and clarity.

An LED display can include of tri-color red, green, blue (RGB) LED packets mounted on printed circuit board (PCB) modules. One RGB LED packet can correspond to a pixel. There is significant variation in the color characteristics of RGB LED packets, even from the same production batch. While most commercially available tri-color LED packets from a production batch may support a traditional color space, such as Rec. 709 that is used in current HD video and is typically suitable for advertising, usually very few of the packets are precise enough to directly support a color gamut such as the DCI-P3 color gamut used in cinemas. Sometimes, a camera calibration system is used to calibrate a display for brightness uniformity. Even if this approach is extended to cover color calibration with a system capable of converting the RGB primary colors from the provided color space to the actual measured primary chromaticities and intensities of each LED, the section of the color gamut of every LED packet in the display restricts the overall achievable color gamut, resulting in a quite small color gamut. This means that careful selection of RGB LED packets is used, which results in a low yield and high cost.

Cinema content is normally distributed in 2K or 4K resolutions, but for very large screens and immersive cinema, where audiences in front rows are sitting close to the screen relative to the screen size, four LED packets per pixel may be used. Each LED packet in a pixel may emit essentially the same color to overcome the so-called "screen door" effect, where audiences are able to resolve the dark spaces between illuminated areas of pixels. Using four LED packets instead of one packet per pixel in a 4K display increases the number of LED packets from approximately 9 million packets to approximately 35 million packets. 35 million carefully selected LED packets may be too costly and time consuming for a cinema application.

Tri-color LED packets are normally grouped into bins after characteristics including center wavelength are determined. LED packets from very few of these bins may support wide color gamuts, such as DCI P3, or wider color gamuts, making it expensive to provide 100 million usable LEDs for a wide color gamut display.

BRIEF DESCRIPTION OF THE DRAWINGS

FIG. 6 is an example of an alternative set of center wavelength ranges for the layouts shown in FIG. 5 according to one example of the present disclosure.

FIG. 8 is a color space table for a pixel and at least one entry of data for each color space in the set of color spaces that is selected according to one example of the present disclosure.

FIG. 9 is an example of a table of calculated color precision values and pixel uniformity values for a pixel code value in five different example color spaces according to one example of the present disclosure.

DETAILED DESCRIPTION

Figure 1:
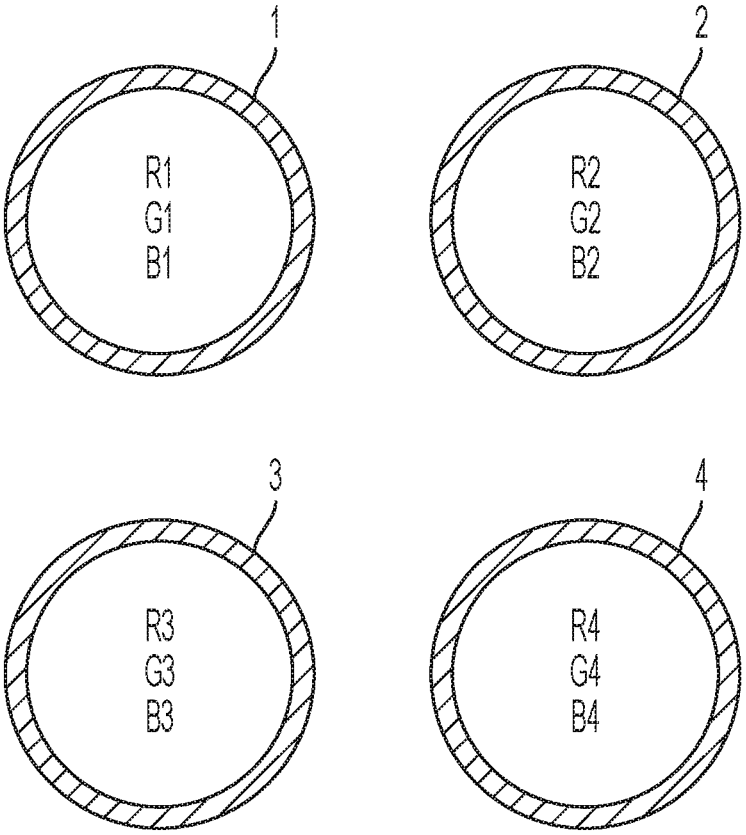
FIG. 1 is a schematic view of an example of a pixel for an active display according to one example of the present disclosure.

Certain aspects and features relate to an active display with an increased color gamut and including a group of LED packets that each form a sub-pixel and that together form a pixel for the display. Each LED packet includes at least a red primary color LED, a green primary color LED, and a blue primary color LED. Each LED can be associated with an intensity value to control the intensity of primary light outputted by the LED. The group of LED packets can output light in a color gamut of a color space for the active display that is different than the color gamut that can be achieved by each LED packet individually. For example, each LED packet of the group of LED packets, individually, can output light in the color gamut of a subset of the color space. The active display can display a visual media presentation to an audience. An increased fraction of LEDs from a production batch can be used in the active display.

An active display according to one example includes RGB LED packets with LEDs that have individually adjustable intensities. A group of RGB LED packets, such as a group of four packets with twelve LEDs, can each represent sub-pixels and together correspond to a pixel for the display. Light for each LED can be modulated, such as by pulse-width modulation, to individually adjust the intensities for the LEDs. A display color gamut can be selected for the pixel. The display color gamut may be a wide color gamut, for example the color gamut of DCI-P3 potentially augmented with a fourth green primary to further cover most of the color gamut of Rec. 2020.

Each LED packet for the pixel can be selected from a corresponding set of manufacturing bins that are selected using a selection criteria to ensure that with every combination of actual possible chromaticities of LEDs in LED packets that may be selected, it is possible to recreate essentially any color within the display color gamut by adjusting the intensity of each of the LEDs. Actual chromaticities and on-state luminous intensities of the LEDs at operating conditions can be recorded, for example by a calibration camera where a custom filter can be inserted in front of the lens. A pixel code value for a color to be displayed can be provided in a standard wide color gamut color space, for example CIE XYZ or Rec. 2020. Using the recorded chromaticities and on-state luminous intensities, a conversion can be performed to twelve intensity values—e.g., one for each LED for the pixel. The intensity values may be represented as red, green, and blue primary intensity values along with a set of attenuation values. Each intensity value and associated attenuation value can control the attenuation of one LED with respect to the primary intensity. To reduce bandwidth, the attenuation values may be transmitted from a server device to a display with lower precision than the primary intensity values or pre-calculated attenuation values that may be stored in a display. The conversion can maximize the intensity balance between red LEDs, between green LEDs, and between blue LEDs to minimize screen-door effect. For the vast majority of commonly occurring colors, a perfect balance may be achieved. For a smaller fraction of extreme colors, some randomly distributed brightness imbalances may occur.

FIG. 1 shows an example of a pixel that includes four tri-color LED packets—a first LED packet 1, a second LED packet 2, a third LED packet 3, and a fourth LED packet 4—in a configuration of a display according to one example. Each tri-color LED packet includes three LEDs: a red LED, a green LED, and a blue LED. Each LED packet may be selected from one or more bins in which the LED packets are placed by an LED binning process. For example, LED packets from a production batch can be binned according to characteristics including measured chromaticities of the red LEDs, green LEDs, and blue LEDs. The LEDs in FIG. 1 are indicated as R1, R2, R3, R4, G1, G2, G3, G4, B1, B2, B3, and B4. The letter denotes the primary color (i.e., red, green, or blue) and the number denotes which LED packet in which the LED is included. Intensity for an LED can be emitted energy per time unit, for example the duration of a movie frame. The intensity of the LEDs may be controlled by pulse-width modulation (PWM), switching the LEDs between an on-state and an off-state in a duty cycle that is faster than the human visual system can perceive so the energy received at the retina is integrated over time. An example of a suitable duty cycle is 3000 cycles per second.

The intensity of each LED is referred to respectively as R1*i*, R2*i*, R3*i*, R4*i*, G1*i*, G2*i*, G3*i*, G4*i*, B1*i*, B2*i*, B3*i*, and B4*i*. The maximum intensities are referred to respectively as R1*i* max, R2*i* max, R3*i* max, R4*i* max, G1*i* max, G2*i* max, G3*i* max, G4*i* max, B1*i* max, B2*i* max, B3*i* max, and B4*i* max. The coordinates of each LED in a CIE 1931 xyY chromaticity diagram are referred to respectively as R1*x*, R1*y*, G1*x*, G1*y*, B1*x*, B1*y*, R2*x*, R2*y*, G2*x*, G2*y*, B2*x*, B2*y*, R3*x*, R3*y*, G3*x*, G3*y*, B3*x*, B3*y*, R4*x*, R4*y*, G4*x*, G4*y*, B4*x*, and B4*y*. A set of attenuation factors AR1, AR2, AR3, AR4, AG1, AG2, AG3, AG4, AB1, AB2, AB3, and AB4 in which an attenuation value between 0 and 100% may be stored in a memory. The pixel may be configured such that optical energy emitted per duty cycle by the LEDs is controlled by a set of pixel code values R, G, and B and the attenuation factors, so that the optical energy emitted per duty cycle for LED R1 is R1*e*=R×AR1×R1*e* max, for LED R2 is R2*e*=R×AR2×R2*e* max, for LED R3 is R3*e*=R×AR3×R3*e* max, for LED R4 is R4*e*=R×AR4×R4*e* max, for LED G1 is G1*e*=G×AG1×G1*e* max, for LED G2 is G2*e*=G×AG2×G2*e* max, for LED G3 is G3*e*=G×AG3×G3*e* max, for LED G4 is G4*e*=G×AG4×G4*e* max, for LED B1 is B1*e*=B×AB1×B1*e* max, for LED B2 is B2*e*=B×AB2×B2*e* max, for LED B3 is B3*e*=B×AB3×B3*e* max and for LED B4 is B4*e*=B×AB4×B4*e* max.

Although described as being formed by a group of four LED packets, a pixel according to other examples can be formed by fewer than four LED packets or more than four LED packets. For example, two, three, or five or more LED packets can be grouped together to form a pixel. The LED packets can be formed by tri-color LEDs or four or more LEDs per packet in which each of the four LEDs can be a primary color with different chromaticity coordinates. The pixel can also be formed from LEDs physically mounted on a single substrate such that the LED packets in the group are considered one component. Multiple components can be mounted to form a display.

Figure 2:
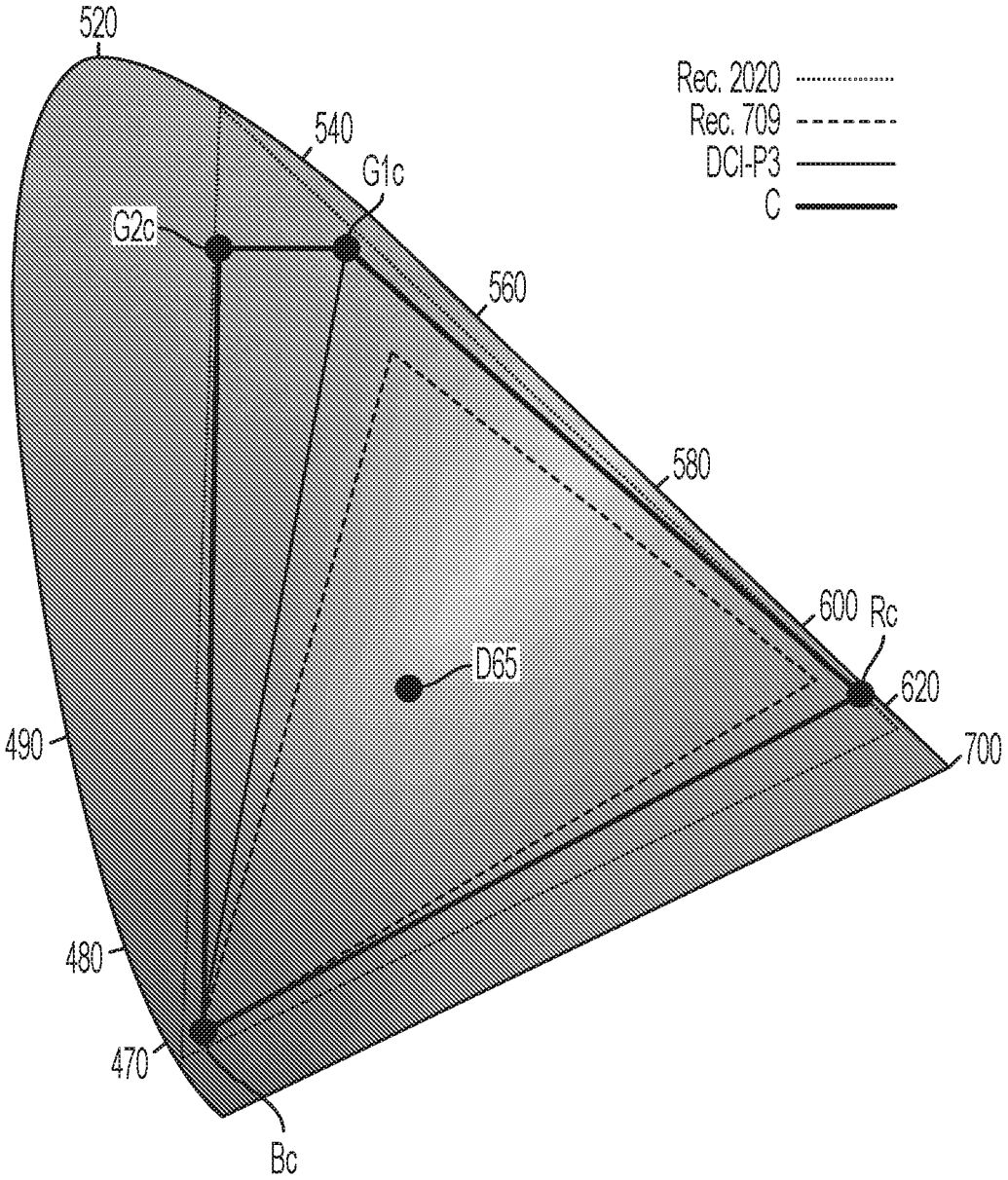
FIG. 2 is an example of a color gamut resulting from primary colors in a CIE 1931 xyY diagram along with the color gamuts of DCI-P3 and Rec. 2020 color spaces according to one example of the present disclosure.

A target color gamut C for a display, which the pixel is desired to support, may be selected as the color gamut of the DCI-P3 color space extended with a range of colors so it covers most of the color gamut of the Rec. 2020 color space except for the extremely saturated colors. The target color gamut may be selected as the color gamut that is reproducible using four target primaries: Rc, G1*c*, G2*c*, and Bc. Rc, G1*c*, and Bc may be three target primaries of the DCI-P3 color space. G2*c* may be selected to have a lower CIE 1931 xyY x chromaticity G2*cx* than G1*c* and so there exist commercially available tri-color LED packets, for example LRTB R48G from Osram, which have a CIE 1931 xyY x-chromaticity that is essentially equal to or lower than G2*cx* and that has a CIE 1931 y-chromaticity value that is essentially equal to or higher than the y chromaticity G2*cy* of G2*c* or higher. An example of CIE 1931 xyY chromaticity coordinates of Rc, G1*c*, G2*c*, and Bc may be Rc=(0.680, 0.320), G1*c*=(0.265, 0.690), G2*c*=(0.167, 0.685) and Bc=(0.150, 0.060). FIG. 2 shows color gamut c that is a range of colors in a color space defined by a perimeter joining the chromaticity coordinates in a CIE 1931 xyY diagram of the primaries Rc, G1*c*, G2*c*, Bc. Also shown in FIG. 2 is the color gamuts of DCI-P3 in a color space defined by a perimeter joining the chromaticity coordinates of the primaries (Rc, G1*c*, Bc). Also shown are the color gamuts of the Rec. 2020 color spaces according to another example.

Figure 3:
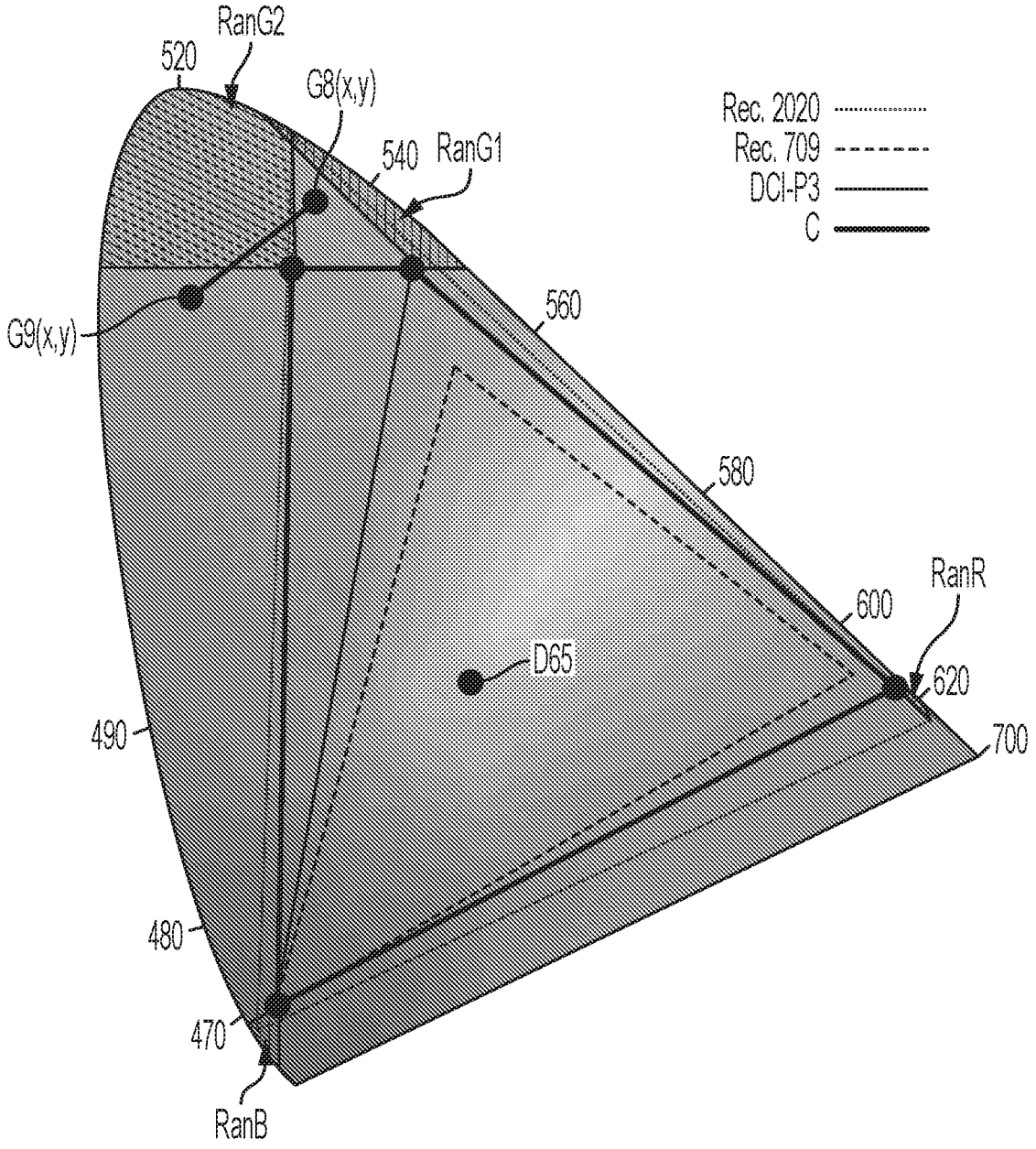
FIG. 3 is an example of ranges of primary colors in a CIE 1931 xyY chromaticity diagram according to one example of the present disclosure.

FIG. 3 depicts an example by which to enable efficient selection of LED packets for the pixel where a range of usable R primaries in an area defined as RanR may be calculated as an area in a CIE 1931 xyY chromaticity diagram delimited by a line through chromaticity coordinates Bc and Rc, a line through G1*c* and Rc, and the perimeter, or spectral locus of the chromaticity diagram. A range of usable G1 primaries in an area defined by RanG1 shown in FIG. 3 may be calculated as an area in a CIE 1931 chromaticity diagram delimited by a line through G2*c* and G1*c*, a line through Rc and G1*c*, and the perimeter of the spectral locus of the chromaticity diagram. A range of usable G2 primaries in an area defined by RanG2 shown in FIG. 3 may be calculated as an area in a CIE 1931 chromaticity diagram delimited by a line through Bc and G2*c*, a line through G1*c* and G2*c*, and the perimeter of the spectral locus of the chromaticity diagram. A range of usable B primaries in an area defined by RanB shown in FIG. 3 may be calculated as an area in a CIE 1931 chromaticity diagram delimited by a line through Rc and Bc, a line through G2*c* and Bc, and the perimeter, also known as the spectral locus, of the chromaticity diagram.

The LED packets may be selected using the following procedure:

A set BinsR of bins that each have a red chromaticity range essentially complete within a RanR chromaticity area is selected. A set BinsG1 of bins that each have a green chromaticity range essentially complete within chromaticity area RanG1 is selected. A set BinsG2 of bins that each have a green chromaticity range essentially complete within chromaticity area RanG2 is selected. And a set BinsB of bins that each have a blue chromaticity range essentially complete within chromaticity area RanB is selected. BinsR, BinsG1, BinsG2, and BinsB may not necessarily be mutually exclusive: e.g., a bin can be potentially within more than one set.

The four LED packets can be selected so at least one comes from a bin within the set BinsR, at least one comes from a bin within the set BinsG1, at least one comes from a bin within the set BinsG2, and at least one comes from a bin within the set BinsB. It may not be necessary for each LED packet to come from a bin within any of the sets. For example, a first LED packet may come from a bin within both the set BinsR and the set BinsG1 and a second LED packet may come from a bin within both the set BinsG2 and the set BinsB, and the last two LED packets may come from bins that are not within any of the sets.

Alternatively, the four LED packets may be selected according to the following:

A set BinsRa of bins with a red chromaticity range essentially equal to a quadrangle shape with corner coordinates in a CIE 1931 xyY diagram (BinsRaX1, BinsRaY1), (BinsRaX2, BinsRaY2), (BinsRaX3, BinsRaY3), (BinsRaX4, BinsRaY4) and a set BinsRb of bins with a red chromaticity range essentially equal to a quadrangle shape with corner coordinates (BinsRbX1, BinsRbY1), (BinsRbX2, BinsRbY2), (BinsRbX3, BinsRbY3), (BinsRbX4, BinsRbY4) are selected so that for every line going through any of the coordinates (BinsRaX1, BinsRaY1), (BinsRaX2, BinsRaY2), (BinsRaX3, BinsRaY3), (BinsRaX4, BinsRaY4) and through any of the coordinates (BinsRbX1, BinsRbY1), (BinsRbX2, BinsRbY2), (BinsRbX3, BinsRbY3), (BinsRbX4, BinsRbY4) it is true the line intersects area RanR A set BinsG1*a* of bins with a green chromaticity range essentially equal to a quadrangle shape with corner coordinates in a CIE 1931 xyY diagram (BinsG1*a*X1, BinsG1*a*Y1), (BinsG1*a*X2, BinsG1*a*Y2), (BinsG1*a*X3, BinsG1*a*Y3), (BinsG1*a*X4, BinsG1*a*Y4) and a set BinsG1*b* of bins with a green chromaticity range essentially equal to a quadrangle shape with corner coordinates (BinsG1*b*X1, BinsG1*b*Y1), (BinsG1*b*X2, BinsG1*b*Y2), (BinsG1*b*X3, BinsG1*b*Y3), (BinsG1*b*X4, BinsG1*b*Y4) are selected so that for every line going through any of the coordinates (BinsG1*a*X1, BinsG1*a*Y1), (BinsG1*a*X2, BinsG1*a*Y2), (BinsG1*a*X3, BinsG1*a*Y3), (BinsG1*a*X4, BinsG1*a*Y4) and through any of the coordinates (BinsG1*b*X1, BinsG1*b*Y1), (BinsG1*b*X2, BinsG1*b*Y2), (BinsG1*b*X3, BinsG1*b*Y3), (BinsG1*b*X4, BinsG1*b*Y4) it is true the line intersects area RanG1

A set BinsG2*a* of bins with a green chromaticity range essentially equal to a quadrangle shape with corner coordinates in a CIE 1931 xyY diagram (BinsG2*a*X1, BinsG2*a*Y1), (BinsG2*a*X2, BinsG2*a*Y2), (BinsG2*a*X3, BinsG2*a*Y3), (BinsG2*a*X4, BinsG2*a*Y4) and a set BinsG2*b* of bins with a green chromaticity range essentially equal to a quadrangle shape with corner coordinates (BinsG2*b*X1, BinsG2*b*Y1), (BinsG2*b*X2, BinsG2*b*Y2), (BinsG2*b*X3, BinsG2*b*Y3), (BinsG2*b*X4, BinsG2*b*Y4) are selected so that for every line going through any of the coordinates (BinsG2*a*X1, BinsG2*a*Y1), (BinsG2*a*X2, BinsG2*a*Y2), (BinsG2*a*X3, BinsG2*a*Y3), (BinsG2*a*X4, BinsG2*a*Y4) and through any of the coordinates (BinsG2*b*X1, BinsG2*b*Y1), (BinsG2*b*X2, BinsG2*b*Y2), (BinsG2*b*X3, BinsG2*b*Y3), (BinsG2*b*X4, BinsG2*b*Y4) it is true the line intersects area RanG2.

A set BinsBa of bins with a blue chromaticity range essentially equal to a quadrangle shape with corner coordinates in a CIE 1931 xyY diagram (BinsBaX1, BinsBaY1), (BinsBaX2, BinsBaY2), (BinsBaX3, BinsBaY3), (BinsBaX4, BinsBaY4) and a set BinsBb of bins with a blue chromaticity range essentially equal to a quadrangle shape with corner coordinates (BinsBbX1, BinsBbY1), (BinsBbX2, BinsBbY2), (BinsBbX3, BinsBbY3), (BinsBbX4, BinsBbY4) are selected so that for every line going through any of the coordinates (BinsBaX1, BinsBaY1), (BinsBaX2, BinsBaY2), (BinsBaX3, BinsBaY3), (BinsBaX4, BinsBaY4) and through any of the coordinates (BinsBbX1, BinsBbY1), (BinsBbX2, BinsBbY2), (BinsBbX3, BinsBbY3), (BinsBbX4, BinsBbY4) it is true the line intersects area RanB.

The four LED packets are selected so at least one comes from a bin within the set BinsRa and another comes from a bin within the set BinsRb, at least one comes from a bin within the set BinsG1*a* and another comes from a bin within the set BinsG1*b*, at least one comes from a bin within the set BinsG2*a* and another comes from a bin within the set BinsG2*b* and at least one comes from a bin within the set BinsBa and another comes from a bin within the set BinsBb.

The selection criteria may result in a slightly higher selection yield from a production batch and may improve intensity uniformity at extreme colors. To further improve yield of usable LED packets, bins can be set up to capture packets that do not have a LED with a primary chromaticity within any of the usable primary ranges such as the primary chromaticity ranges defined by areas RanR, RanG1, RanG2 and RanB in FIG. 3. There can be another range of primaries with a chromaticity outside of the usable primary chromaticity area defined above, in which the other range of primaries when used in combination with two or more LED packets are able to synthesize a primary chromaticity that is within the usable primary chromaticity area. For example, in FIG. 3 there are two chromaticity coordinates G8 and G9 that are outside the usable primary chromaticity areas. With two LED packets, in which one LED packet is able to produce light of the G8(*x,y*) chromaticity and the other LED packet is able to produce light of the G9(*x,y*) chromaticity, it is possible to adjust the light intensity of these two LED packets such that light with chromaticity coordinates defined by a line between G8(*x,y*) and G9(*x,y*) can be achieved. If the line between G8(*x,y*) and G9(*x,y*) intersects a usable primary chromaticity area, such as RanG2, then a usable primary chromaticity can be synthesized within the RanG2 area. To use the additional selection range to achieve a target gamut a selection criterion based on a combination of LED packets in which the individual LED packets have color coordinates outside of usable primary chromaticity areas but can synthesize color coordinates that intersect the usable primary chromaticity areas, the following can be used:

- Bin groups in which a LED packet taken from each bin can have a combination of possible color gamuts of red LED chromaticity coordinates that intersect with the area of usable red primaries;
- Bin groups in which a LED packet taken from each bin can have a combination of possible color gamuts of green LED chromaticity coordinates that intersect with the area of usable green primaries; and
- Bin groups in which a LED packet taken from each bin can have a combination of possible color gamuts of blue LED chromaticity coordinates that intersect with the area of usable blue primaries.

The groups can be two or more bins such that this procedure may give an even higher yield.

Further, the selection criteria may be combined, i.e. one of the above selection criteria may be applied for one primary color red, green or blue and another selection criteria may be applied for another primary color red, green, or blue.

Figure 4:
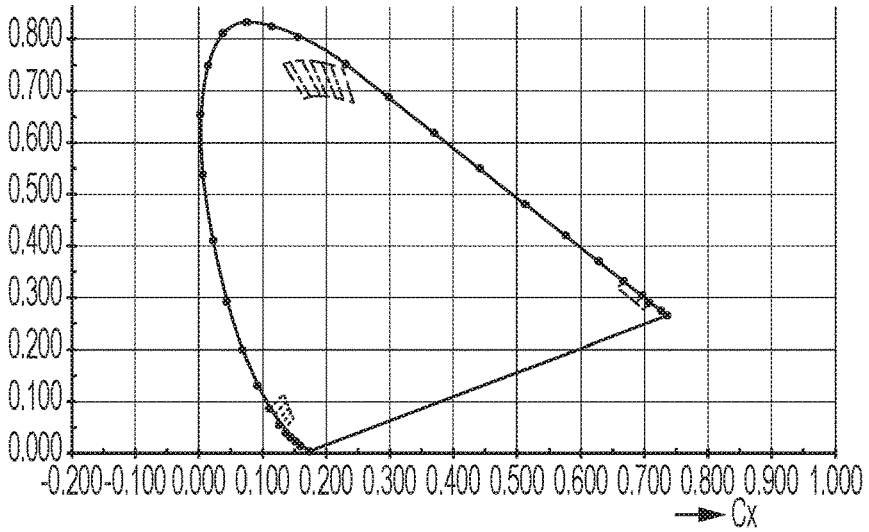
FIG. 4 is a table of an example of selected LED packets from bins and the chromaticity ranges of the bins according to one example of the present disclosure.

FIG. 4 shows a table of an example of selected LED packets from OSRAM Licht AG and the chromaticity ranges of the bins from which the LED packets are selected. A legend to the bin chromaticity ranges commercially available as standard components from OSRAM Licht AG is shown below. (It is noted that with the standard bins published by OSRAM for LED packet type LRTB R48G, some very saturated red colors within DCI-P3 and hence within the example color gamut C may not be supported, as they offer one red chromaticity range binning. In this case, a sub-binning process with respect to the red chromaticity range can be performed after the manufacturers binning, if a strict conformance with DCI-P3 and with the example color gamut C is required. Alternatively, other LED packet types or binning schemes may be used, for example from Osram, Nichia, Everlight, Nationstar, or Cree. LED packets supporting the full DCI-P3 color gamut can be manufactured in volume, but since cinema is a new application for LED packets, published data from manufacturers seem to be still targeted at traditional LED display applications where for example Rec709 color space is satisfactory.)

Some manufacturers publish bin color ranges using center wavelength and separately publish typical spectral distributions. Chromaticity ranges can be calculated from center wavelength range and typical spectral distribution using calculations in the art of colorimetry. The typical spectral distributions for some commercially available LED packets may exclude the most saturated colors within the color gamut of, for example, Rec. 2020. Some commercially available LED packets may have spectral distributions that also exclude a small percentage of the colors within DCI-P3. In some cases, this percentage may be small enough to be acceptable.

Figure 5:
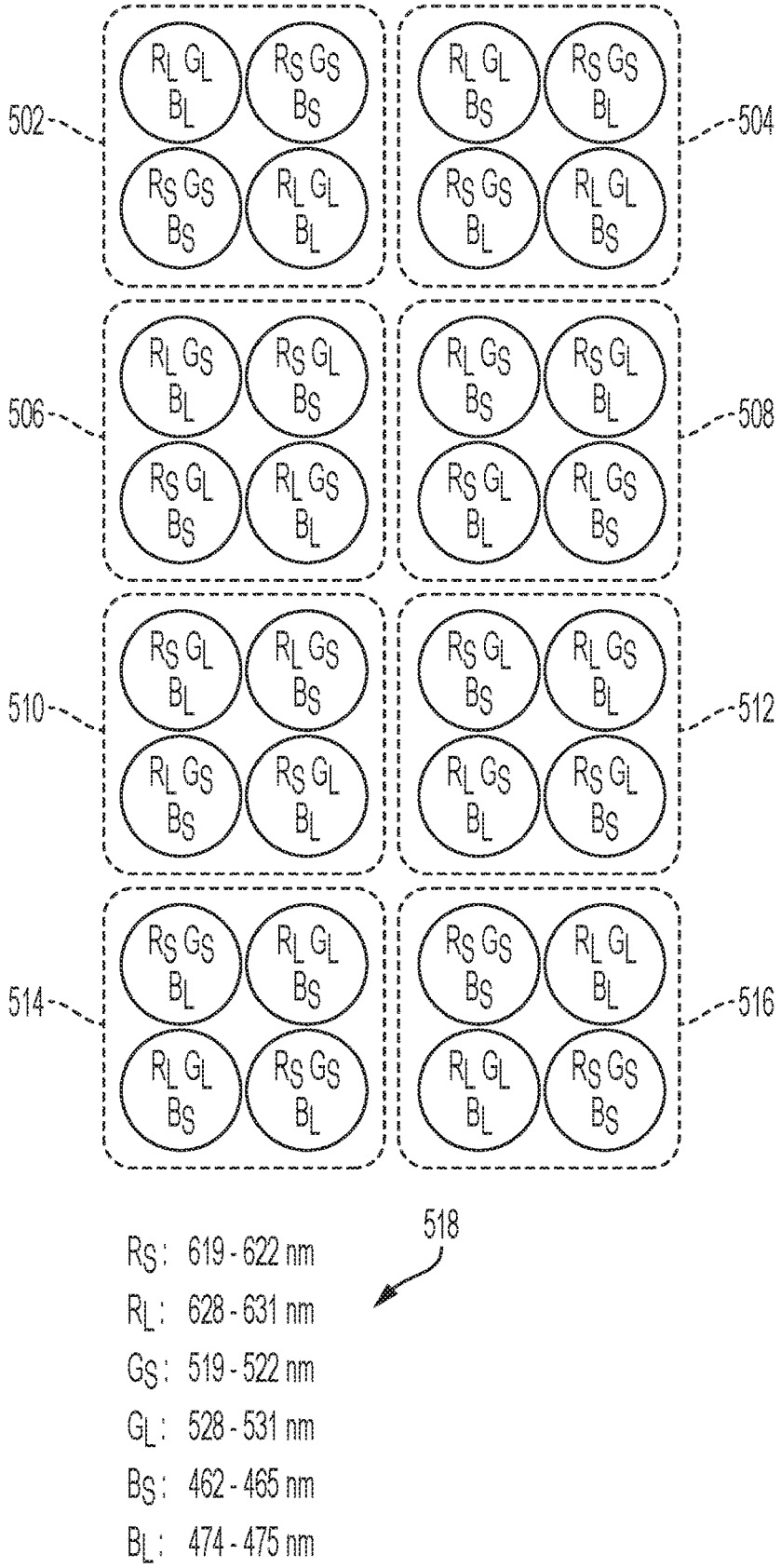
FIG. 5 is an example of eight LED packets for a pixel with corresponding color ranges expressed as center wavelengths according to one example of the present disclosure.

FIG. 5 shows an example of eight groups of LED packets 502-516 of an active display according to one example. The LED packets 502-516 have corresponding color ranges 518 expressed as center wavelengths. S and L designates a short wavelength and a long wavelength, respectively, for a particular primary color. A number of different LED packet layouts with the different center wavelengths for pixels in a display can be used, as more than one layout may increase selection yield from a production batch and may further reduce visible repetitiveness of spatial non-uniformities of pixels within a multitude of pixels due to different center wavelength characteristics of LED packets in pixels. Additionally, pixels of different center wavelength layouts may be arranged in random, pseudo-random, or non-uniform patterns in a display since this may further reduce visible repetitiveness of spatial non-uniformities of packet color and intensity.

FIG. 6 shows an alternative set of center wavelength ranges for the layouts shown in FIG. 5 and corresponding color bin limits published for the CLMXB-FKA tri-color SMD LED packet from Cree Inc. Cree offers one red color bin, but values within this bin can be very close to the tolerances used, for example, for the DCI-P3 color space.

More precise data about the chromaticities and intensities of the LEDs in the LED packets in the pixel than the bin ranges may be provided by measurements, as an example. Measurements may be performed subsequent to LED packet selection, subsequent to manufacturing of a display comprising the pixel, subsequent to installation of the display, or during maintenance of the display. The actual chromaticity values of each LED may be measured by colorimetry processes. Alternatively, the center wavelengths may be measured and chromaticity values may be calculated using published data about typical spectral distribution of the different types of LEDs in the LED packets. Additionally, maximum intensities during PWM modulation may be measured, i.e. intensities at maximum intensity PWM modulation. Alternatively, the luminous intensity of LEDs in the on-state may be measured and maximum intensities during PWM modulation may be calculated using optical calculation methods. Measurements may be performed when the LED packets are under similar conditions as during expected normal operation, where similar conditions may include for example forward currents, operating time, and ambient temperature.

The measurements may be performed using a camera to record at least two images of the pixel. At least one image can be recorded using a color filter inserted in front of the camera. The spectral distribution of an LED wavelength may be provided by published data from the manufacturer, and may be assumed constant between LEDs of the same primary color even if the LEDs have different center wavelengths. And the filter may have decreasing or increasing attenuation with increasing wavelength within each of the red, blue, and green spectral regions. The center wavelength may be calculated from image data recorded with the filter inserted, the image data recorded without the filter inserted, and from a provided spectral distribution. The maximum intensity of a first LED having a primary color may be measured in constant values or relative to a second LED in a display that has the lowest maximum intensity of all LEDs in the display of the primary color. The camera may be a color camera and may record all LEDs in an LED packet essentially at the same time. Alternatively, the camera may be monochrome and may record LEDs of one primary color in an LED packet at a time, and LEDs in the LED packet of only one primary color may be illuminated at a time. The camera may record all LED packets in the pixel at the same time. Camera calibration software may take the at least two recorded images as input and calculate as output a table with a measured chromaticity value and a measured maximum intensity value for each LED in the pixel. The camera calibration software may be able to compensate for gaps between light sensitive areas in the sensor of the camera (i.e.

between sensor pixels). The camera may be a high-resolution camera and may record images of more than one pixel in a display at essentially the same time.

A set of red LED attenuation values (e.g., AR1, AR2, AR3, and AR4) for a pixel, a set of green LED attenuation values (e.g., AG1, AG2, AG3, and AG4) for the pixel, and a set of blue LED attenuation values (e.g., AB1, AB2, AB3, and AB4) for the pixel may be calculated and stored. Each set of red LED attenuation values may include attenuation values that range between 0% attenuation and 100% attenuation, one attenuation value corresponding to each of the red LED packets in the group of LED packets. An attenuation value can control the intensity of a corresponding red LED so it is essentially equal to a provided red intensity control value that can be a code value. The code value can be a numerical representation of the red LED intensity in a process that controls the red LED in a pixel. Each set of green LED attenuation values may include a set of attenuation values, one attenuation value for each green LED in the group of LED packets, which can control the intensity of a corresponding green LED so it is essentially equal to a provided green intensity control value that can be a code value. The code value can be a numerical representation of the green LED intensity in a process that controls the green LED in a pixel. Each set of blue LED attenuation values may include a set of attenuation values, one attenuation value for each of the blue LEDs, which can control the intensity of a corresponding blue LED so it is essentially equal to a provided blue intensity control value that can be a code value. The code value can be a numerical representation of the blue LED intensity in a process that controls the blue LED in a pixel.

A color space can be defined by sets of attenuation values where one set of attenuation values corresponds to each color of LED in the group of LED packets. For example, a color space can be defined by three sets of attenuation values that may include a first set of attenuation values for each color in the group of packets. A first set of attenuation values (Aru) for the red LEDs in the group may be optimized for intensity uniformity within the group of packets. Uniformity optimization may be calculated by identifying a first red LED in the pixel that has the lowest maximum intensity, setting the corresponding attenuation value to 0% (i.e., no attenuation), and calculating the other attenuation values in Aru using the measured maximum intensities so that the intensities of the other red LEDs are essentially equal to the first red LED. Likewise, a first set of attenuation values (Agu) for green LEDs may be optimized for intensity uniformity, and may be calculated by identifying a first green LED in the pixel that has the lowest maximum intensity, setting the corresponding attenuation value to 0%, and calculating the other attenuation values in Agu using the measured maximum intensities so that the intensities of the other green LEDs are essentially equal to the first green LED. Likewise, a first set of attenuation values (Abu) for blue LEDs may be optimized for intensity uniformity, and may be calculated by identifying a first blue LED in the pixel that has the lowest maximum intensity, setting the corresponding attenuation value to 0%, and calculating the other attenuation values in Abu using the measured maximum intensities so that the intensities of the other blue LEDs are essentially equal to the first blue LED.

Another color space can be defined by a different three sets of attenuation values. For example, a second set Arp of attenuation values for the red LEDs may be optimized for precision in reproducing colors within a color gamut defined by the target primaries Rc, G1*c*, and Bc, which may be primaries of the DCI-P3 color gamut. The set Arp may be provided by a calculation that includes selecting a set of four attenuation values, so combined light from the red LEDs when at illuminated at maximum intensity attenuated by the corresponding attenuation value within the set of four attenuation values has a chromaticity within RanR. The calculation may include iterating through combinations of attenuation values and stopping when the resulting chromaticity is within RanR. For example, the combinations of attenuation values can be implemented in sixteen steps for each value, where the steps may include no attenuation to full attenuation.

Alternatively, the calculation or iteration may select a set of attenuation values so the combined light is within RanR and the red intensity uniformity is maximized. Light uniformity within the pixel can create a pixel that is more effective at reducing screen-door effect because the LED packets within the pixel are emitting a more uniform amount of light. A pixel that uses attenuation values, such as the precision attenuation set, to increase the color gamut may result in the LEDs within the pixel having different light levels to the point the pixel does not have uniform light being emitted from the LED packets in the pixel that can make screen-door artifact or other spatial artifacts more visible. This situation can result in having to determine a tradeoff between using pixels that have a wider color gamut, but cause an increase in screen-door artifact versus pixels that appear more uniform and can reduce screen-door effect but do not have a wide color gamut. The red intensity uniformity may be calculated as the distance of an intensity centroid of light from the red LEDs in the pixel to a center of the pixel.

Likewise, a second set of attenuation values for the green LEDs is a set (Agp) that may be optimized for precision in reproducing colors within a color gamut defined by the target primaries Rc, G1*c*, and Bc, which may for example be the DCI-P3 color gamut. The set Agp, may be provided by a calculation that includes selecting a set of four attenuation values, so mixed light from the green LEDs when at illuminated at maximum intensity attenuated by the corresponding attenuation value within the set of four attenuation values has a chromaticity within RanG1. The calculations can be performed similar to those described above with respect to red LEDs. Likewise, a second set of attenuation values for blue LEDs is a set (Abp) that may be optimized for precision in reproducing colors within a color gamut defined by the primaries Rc, G1*c*, and Bc, which may for example be the DCI-P3 color gamut. The set Abp may be provided by a calculation that includes selecting a set of four attenuation values, so combined light from the blue LEDs when at illuminated at maximum intensity attenuated by the corresponding attenuation value within the set of four attenuation values has a chromaticity within RanB. The calculations can be performed similar to those described above with respect to red LEDs.

A third color space can be defined by another three different sets of attenuation values by using attenuation set Arp, Abp with a set that is a third set Ag3 of attenuation values for green LEDs, which may be optimized for precision in reproducing colors within a color gamut defined by the target primaries Rc, G2*c* and Bc. The third set Ag3 may be provided by a calculation that includes selecting a set of four attenuation values, so combined light from the green LEDs when illuminated at maximum intensities and attenuated by their set Ag3 of attenuation values has a chromaticity within RanG2 The calculations can be performed in a similar manner as those described above with respect to red LEDs.

A pixel can target primaries Rc, G1*c*, G2*c*, and Bc to increase the color space of the DCI-P3 color gamut using four different attenuation sets (Arp, Abp, Ags, and Agp)

Additional sets of attenuation values may be calculated to increase the range of colors supported when using the attenuation values. For example, a set of fourth green LED attenuation values Ag4 and a set of fifth green LED attenuation values Ag5, as described with respect to FIG. 7, may be calculated so the chromaticities of the resulting combined light from the green LEDs when Ag4 and Ag5 are applied essentially lies on a line between G1 and G2 in the xyY chromaticity diagram. For example, the chromaticities Pgp, Pg4, Pg5 and Pg3 can be created by attenuation sets Agp, Ag4, Ag5, and Ag3, respectively, such that the chromaticities can be uniformly distributed on the chromaticity chart along a predefined line. For example, Ag4 and Ag5 may each be calculated by iterating through combinations of attenuation values, calculating the chromaticity, and finding a chromaticity Pg4 and Pg5 that is close to a desired point on a line between G1 and G2.

Figure 7:
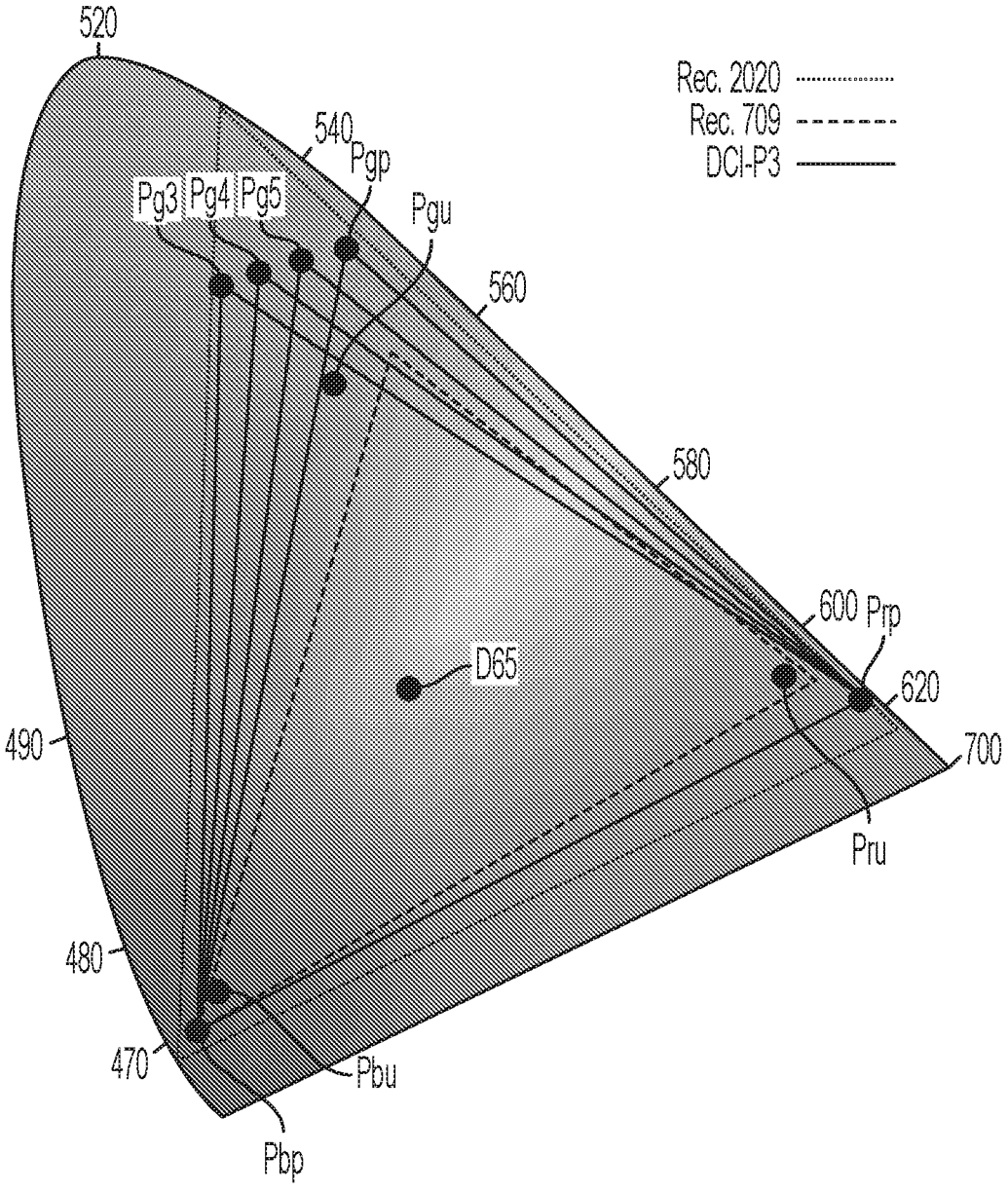
FIG. 7 is a CIE 1931 xyY chromaticity diagram with primary colors indicated according to one example of the present disclosure.

FIG. 7 shows a CIE 1931 xyY chromaticity chart with various color spaces created by different primaries where the different primaries can be synthesized primaries according to one example. The different primaries are created by using the different attenuation sets. For example, using attenuation set Aru of attenuation values, a chromaticity Pru of combined light from the red LEDs when Aru is applied may be calculated. Likewise, for the attenuation values Arp a chromaticity Prp of combined light from the red LEDs when Arp is applied may be calculated. For the attenuation set Agu of attenuation values, a chromaticity Pgu of combined light from the green LEDs when Agu is applied may be calculated. For the attenuation set Agp attenuation values, a chromaticity Pgp of combined light from the green LEDs when Agp is applied may be calculated. For the attenuation set Ag3 of attenuation values, a chromaticity Pg3 of combined light from the green LEDs when Ag3 is applied may be calculated. For the attenuation set Ag4 of attenuation values, a chromaticity Pg4 of combined light from the green LEDs when Ag4 is applied may be calculated. For the attenuation set Ag5 of attenuation values, a chromaticity Pg5 of combined light from the green LEDs when Ag5 is applied may be calculated. For the attenuation set Abu of attenuation values, a chromaticity Pbu of combined light from the blue LEDs when Abu is applied may be calculated. For the attenuation set Abp of attenuation values, a chromaticity Pbp of combined light from the blue LEDs when Abp is applied may be calculated.

When selecting between applying Aru and Arp, the effect can be similar to selecting between two different synthesized red primaries Pru and Prp that can have their intensity controlled by the red intensity value. When selecting between applying Agu, Agp, Ag3, Ag4, and Ag5, the effect can be similar to selecting between five different synthesized green primaries Pgu, Pgp, Pg3, Pg4, and Pg5 that can have their intensity controlled by the green intensity value. When selecting between applying Abu and Abp, the effect can be similar to selecting between two different synthesized blue primaries Pbu and Pbp that can have their intensity controlled by the blue intensity value.

Primaries Pru, Prp, Pgu, Pgp, Pg3, Pg4, Pg5, Pbu and Pbp indicated in FIG. 7 can be considered synthesized primaries available for reproducing different color spaces by the pixel. Additional attenuation values may be added to support more colors or to support specific colors with better intensity uniformity.

A set of color spaces may be created by selecting a red primary, a green primary, and a blue primary from the available synthesized primaries. For example, a first color space Cu may be created by using primaries Pru, Pgu, and Pbu, with attenuation sets Aru, Agu, and Abu. A second color space Cp may be created by using primaries Prp, Pgp, and Pbp with attenuation sets Arp, Agp, and Abp, a third color space C3 may be created by using primaries Pru, Pg3, and Pbu with attenuation sets Aru, Ag3, and Abu, a fourth color space C4 may be created by using primaries Pru, Pg4, and Pbu with attenuation sets Aru, Ag4, and Abu, and a fifth color space C5 may be created by using primaries Pru, Pg5, and Pbu with Aru, Ag5, and Abu.

The pixel may be switched to operate in a desired color space within the set of color spaces Cu, Cp, C3, C4 and C5 by applying the three sets of attenuation values corresponding to each of the primaries in the desired color space. By switching between sets of attenuation values, it is possible to switch the color space of a display pixel between two separate color spaces. For example, one set of attenuation values can correspond to one color space and another set of attenuation values can correspond to a different color space. By switching between the sets of attenuation values, the color space for the display can switched. If image data of the visual media presentation received by a display has image pixel data with a chromaticity coordinate outside of the color gamut of a pixel of a standard display (e.g., Rec 790), the display pixel color space can be switched to accommodate an extended color space (e.g., Rec. 2020) for a duration for the image pixel to be displayed. By switching a display pixel between a first color space and a second color space, it can be possible to switch the display pixel color space based on image pixel color. The attenuations may be performed in a display and a server may switch the pixel to a desired color space by transmitting different sets of attenuation values. The attenuation values may be transmitted with lower resolution than primary intensities, thereby saving bandwidth to the display. Alternatively, the attenuation values may be stored in the display and a server may send a color space identifier, indicating the color space to which to switch the pixel.

A common whitepoint for the color spaces may be selected and this may be for example the DCI-P3 D65 whitepoint and may have CIE 1931 xyY chromaticity coordinates (0.3127, 0.3290). Content image data can be in a standard color space. To show image content on a pixel that is of a different color space, the image content can be processed through a color space conversion or transformation to the color space of the display.

FIG. 8 shows a color space table for a pixel and may include at least one entry of data for each color space in the set of color spaces that is selected. An entry may include a color space identifier 1-5, a corresponding set of primary coordinates (Rx, Ry), (Gx, Gy), (Bx, By), a corresponding set of whitepoint-calibrated primary intensity values (Ar, Ag, Ab) and a corresponding set of LED attenuation values (Ar1, Ar2, Ar3, Ar4, Ag1, Ag2, Ag3, Ag4, Br1, Br2, Br3, and Br4). The table may be stored in a media server that may transmit image data to a display that includes the pixel. After the color space table is created, the color space identifier and corresponding set of attenuation values may be copied to an attenuation table that may be stored in a display that includes the pixel. The display can apply, to a pixel, the corresponding set of attenuation values to a color space identifier that may be transmitted from a media server to the display. It may be possible for the media server to switch a pixel in the display by transmitting a color space identifier for the pixel.

The color space identifier may be transmitted together with R, G, and B intensity values for the pixel and may be represented by a four-bit binary number.

A pixel code value for a color to be displayed by the pixel may be provided. The pixel code value may be represented in a standard wide color gamut color space, for example CIE 1931 XYZ color space or the color space defined in ITU-R BT. 2020, also referred to as Rec. 2020. A color space conversion may be performed for each of the color spaces in the selected set of color spaces, converting the pixel code value into R, G, and B intensities for each color space using the corresponding primary coordinates (Rx, Ry), (Gx, Gy), and (Bx, By) and the corresponding white point calibration values.

For at least one color space in the selected set of color spaces (1-5), a calculation may be performed of a color precision value of light from LEDs in the pixel when the pixel is reproducing the color resulting from the conversion of the pixel code value from the standard wide color gamut color space to the at least one color space. The color precision value can indicate the precision with which the color represented by the pixel code value is reproduced. The color precision value may be between 0% and 100% and may be calculated by converting the R, G, and B intensities in the at least one color space into CIE 1931 xyY chromaticity point and setting the color precision value to 100% if the xyY chromaticity point lies within a rectangle in a CIE 1931 xyY diagram suspended by corners (Rx, Ry), (Gx, Gy) and (Bx, By). The color precision value may be set to 0% if the chromaticity point lies outside the rectangle. Alternatively, it may be calculated by calculating a distance Dc from the chromaticity point to a nearest line segment between any of the corners (Rx, Ry), (Gx, Gy), and (Bx, By), and setting the color precision value to 0% if Dc is greater than a selected threshold Dct which may be 0.1 and if Dc is smaller than or equal to Dct setting the color precision value to 1−Dc/Dct. Alternatively, the color precision value may be calculated using just noticeable chromaticity differences, also referred to as MacAdam ellipses.

For at least one color space in the selected set of color spaces (1-5), a pixel uniformity value of the pixel can be calculated when the pixel is reproducing the color resulting from the conversion of the pixel code value from the standard wide color gamut color space to the at least one color space. The pixel uniformity value can indicate the perceived spatial uniformity of the pixel when the color represented by the pixel code value is reproduced. The pixel uniformity value may be between 0% and 100% and may be calculated as an average of a red uniformity value, a green uniformity value, and a blue uniformity value. The red uniformity value may be calculated as the sum of the numerical differences of the intensity of each red LED from an average red intensity. The green uniformity value may be calculated as the sum of the numerical differences of the intensity of each green LED from an average green intensity. The blue uniformity value may be calculated as the sum of the numerical differences of the intensity of each blue LED from an average blue intensity. The average red intensity may be calculated as the sum of intensities of red LEDs divided by the number of LED packets, which may be four. The average green intensity may be calculated as the sum of intensities of green LEDs divided by the number of LED packets. The average blue intensity may be calculated as the sum of intensities of blue LEDs divided by the number of LED packets. Alternatively, the pixel uniformity value may be calculated as a brightness uniformity value that is determined as the sum of numerical differences of the brightness of each LED packet from an average brightness. The average brightness may be calculated as the sum of the brightness of each LED packet divided by the number of LED packets. The brightness of an LED packet may be calculated as the Y value in the CIE 1931 xyY chromaticity model of light mixed from the red, the green, and the blue LEDs in the LED packet using the measured chromaticity values of the LEDs and a calculated intensity for each LED. An intensity for an LED may be calculated by multiplying the measured maximum intensity of the LED by the attenuation factor corresponding to the LED in the at least one color space. Alternatively, the pixel uniformity value may be determined by a calculation using other color or brightness uniformity rating methods and in the calculation the pixel may be considered a display having a number of pixels corresponding to the number of LEDs in the pixel, for example four, using measured chromaticities and calculated intensities for each LED as pixel values.

FIG. 9 shows an example of a table of calculated color precision values and pixel uniformity values for a pixel code value in five different example color spaces numbered 1 to 5 that can also be color spaces such as Cu, Cp, C3, C4, and C5. The color space can be selected based on a tradeoff between the precision of the color of the pixel and the uniformity of the color intensity of the pixel. For example, a color space can be selected to provide a maximum precision with only a slight degradation in uniformity. A color space Cs for the pixel may be selected by identifying a set of precisely reproducing color spaces in the set of selected color space that has a color precision value essentially equal to 100%. From the set of precisely reproducing color spaces, a Cs can be selected as a color space with a highest pixel uniformity value, i.e. a color space for which it is true that no other of the color spaces in the set of selected color spaces has a higher pixel uniformity value. If none of the color spaces in the selected set of color spaces has a color precision value essentially equal to 100%, the set of precisely reproducing color spaces may be selected by selecting the color space with the highest color precision. In the table, the color represented by the provided pixel code value can be reproduced with a color precision value equal to essentially 100% by several color spaces, including the color space if Cs is selected to be the color space with a color space identifier equal to 2, which further has a pixel uniformity value essentially equal to 100% (because this color space was selected for maximized uniformity). The color indicated by the provided pixel code value can be represented by the pixel with a color precision value of essentially 100% and a pixel uniformity value of essentially of color space Cs is selected. With a color space calculated as described for the color space with color space identifier 2, it may be the case that the vast majority of commonly occurring colors can be reproduced with essentially 100% pixel uniformity.

The color space identifier corresponding to Cs may be provided to a display that includes the pixel. For example, the identifier may be transmitted from a media server to the display. The display may apply attenuation factors corresponding to the color space identifier of Cs to the pixel and the provided pixel code value may be converted into R, G, and B primary intensities in a color space essentially equal to Cs and provided to the pixel. The color space identifier corresponding to Cs and the converted R, G, and B primary intensities may be provided to the display that includes the pixel. For example, for every frame of a video stream the color space identifiers may be transmitted from a media server to the display. Alternatively, the R, G, and B primary intensities may be transmitted for every frame, and the color space identifier corresponding to Cs may be transmitted only when it changes as a new color to be reproduced causes a new color space to be selected.

Alternatively, the color space Cs may be selected as a set of maximum weighted average of the color precision value and the pixel uniformity value. A weight value used for calculation of the weighted average may be provided. The weight value may be a configurable system parameter, for example stored in a media server. The weight can be set to a maximum color precision with a small amount of spatial non-uniformity artifacts at extreme colors that audiences in the front rows can tolerate. Or the weight can be set to a maximum spatial uniformity of pixels for all audience members with no artifacts, even at front rows, but some compromise in precision of some of the extremely saturated colors. Even when displaying a movie of a wide color gamut, the artifacts at the front rows may be significantly less distracting than the screen-door artifacts of a display with only one LED packet per pixel for any color gamut. For colors within a smaller color gamut, such as Rec. 709, there may be no non-uniformity artifacts. The determination of the color space to be selected can be done at a central processor device such as a server device that can be a media server external to a display or the determination can be made locally near the pixel by a processor device that can be an ASIC or FPGA in a display.

Figure 10:
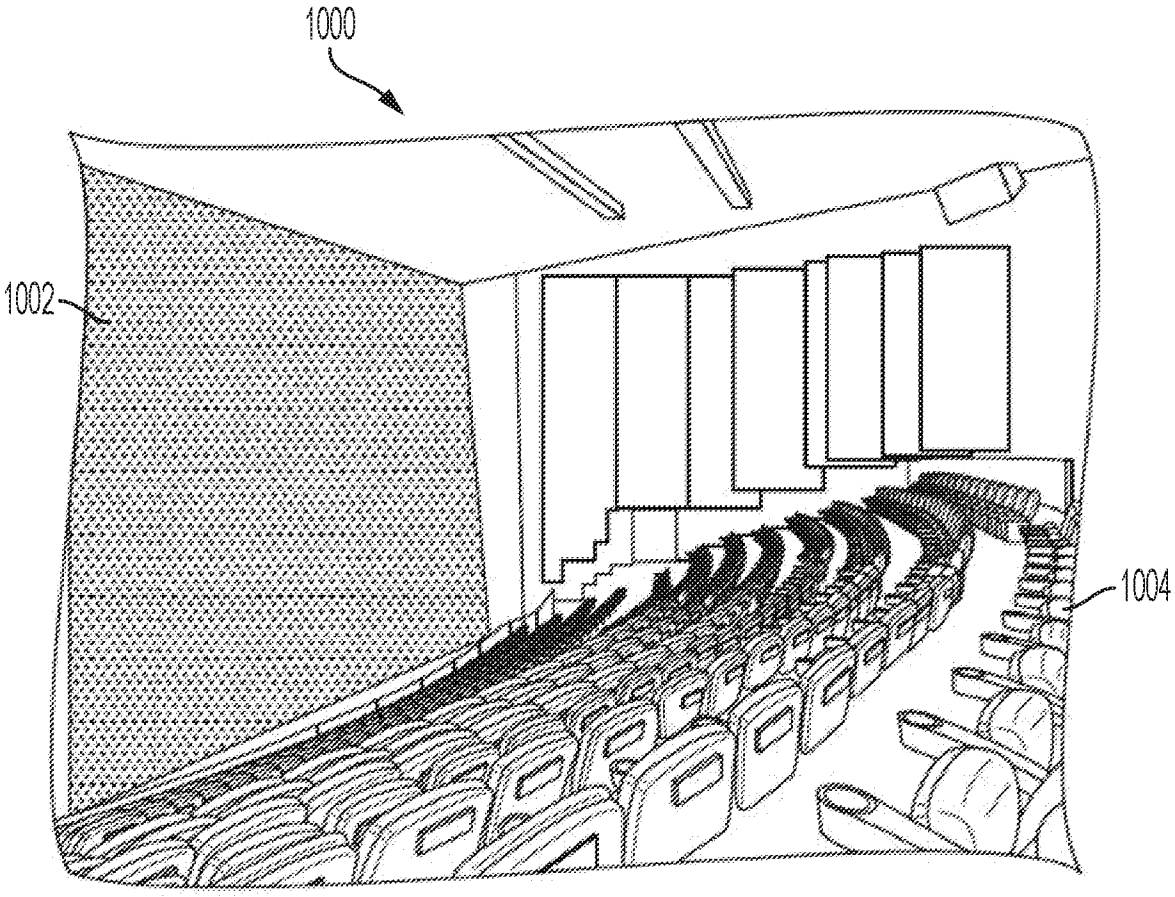
FIG. 10 is a perspective view of a theatre environment that includes an active display with reduced screen-door effect according to one example of the present disclosure.

Various aspects of the present disclosure can be used in a theater environment, such as an immersive theater environment provided by IMAX Corporation, that has an active display with reduced screen-door effect. FIG. 10 is a perspective view of a theatre environment 1000 that includes an active display 1002 with reduced screen-door effect. The active display 1002 can include light-emitting packets that output light that can represent a visual presentation, such as a movie, toward an audience-seating area 1004. The active display 1002 can also include one or more of the features described previously. For example, the active display 1002 may include pixels that are each formed by sub-pixels defined by LED packets. Each LED packet can include LEDs corresponding to primary colors and the intensity of light outputted by each LED can be individually controlled such that the LED packets forming the pixel output a wide color gamut for the display or the LED packets output a wide color gamut that is based on a tradeoff with uniformity of light emitted by the LED packets. Because the active display 1002 can output light representing a visual presentation toward the audience-seating area 1004, the theatre environment 1000 may not be required to include projection equipment, as would otherwise normally be used for non-active displays in theatre environments.

The theatre environment 1000 can be an immersive one that provides increased resolution, as compared to a typical theatre, and the audience-seating area 1004 can be much closer to the active display 1002 than as compared to a typical theatre. For example, all rows of seats in the audience-seating area 1004 can be a distance from the active display 1002 that is within a third of a screen width of the active display 1002. For example, the active display 1002 can be much larger than a typical theatre display—e.g., a length of approximately 70 feet and a height of approximately 50 feet (or even as large as approximately 117 feet in length). In the example in which the active display 1002 has a width of approximately 70 feet, all of the seats in the audience-seating area 1004 can be within 20 feet from the active display 1002. The theatre environment 1000 may be in a purpose-built structure for an immersive theatre experience, or in a retrofitted auditorium that formally house a typical theatre environment.

In other examples, an active display with reduced screen-door effect according to various aspects can be used in a typical theatre environment in which the audience-seating area is farther from the active display (e.g., 50% of the screen width away) and the size of the active display is smaller than the example described in connection with FIG. 10.

Figure 11:
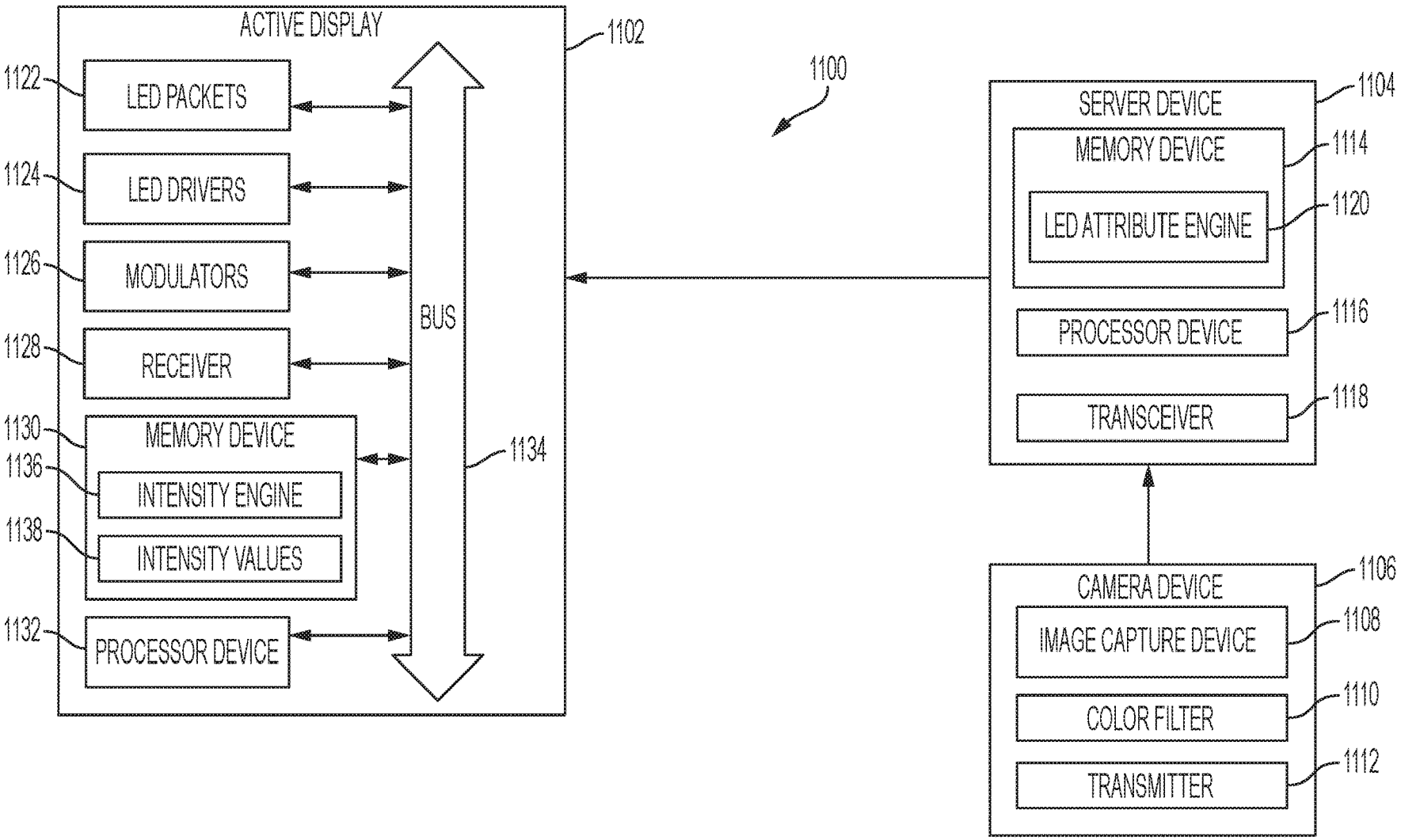
FIG. 11 is a schematic block diagram of a system for outputting a visual presentation to an audience in a theatre setting according to one example of the present disclosure.

FIG. 11 is a schematic block diagram of a system 1100 for outputting a visual presentation to an audience in a theatre setting, such as the immersive theatre setting in FIG. 10, according to one example of the present disclosure. The system 1100 includes an active display 1102, a server device 1104, and an image acquisition device, such as a camera device 1106. The camera device 1106 can capture image information outputted by the active display 1102 and provide the captured image information to the server device 1104. The server device 1104 can determine parameters for LEDs of the active display 1102 using the captured image information and provide the parameters to the active display 1102 for controlling the LEDs.

The camera device 1106 includes an image capture device 1108, a color filter 1110, and a transmitter 1112. An example of the image capture device 1108 is a lens and an image sensor. The image capture device 1108 can capture at least two images of the output of one or more pixels of the active display 1102. At least one of the images can be captured with the color filter 1110 positioned in front of the lens and at least one other image can be captured without the color filter 1110 positioned in front of the lens. The captured image data can be transmitted to the server device 1104 by the transmitter 1112. In some examples, the transmitter 1112 can transmit the captured image data via a wired or wireless connection with the server device 1104. Although not depicted, the camera device 1106 may also include a memory device for storing captured image data or for performing analysis on the captured image data and providing the results of the analysis to the server device 1104.

The server device 1104 includes a memory device 1114, a processor device 1116, and a transceiver 1118. The transceiver 1118 can transmit and receive data with other components of the system 1100, such as receiving the captured image data from the camera device 1106. The memory device 1114 is a non-transitory computer-readable medium on which code can be stored. The code can represent data and instructions that can be executed by the processor device 1116 to cause the server device 1104 to perform actions. For example, the code can include an LED attribute engine 1120 that can be executed by the processor device 1116 to cause the server device 1104 to determine attributes for LEDs forming a pixel on the active display 1102. The attributes can be determined from the captured image data received from the camera device 1106. Examples of the attributes can include an intensity value for each LED forming a pixel on the active display 1102. In some examples, the attributes may include an attenuation value for each LED forming the pixel on the active display 1102. The attributes can be transmitted to the active display 1102 by the transceiver 1118.

The active display 1102 includes LED packets 1122, LED drivers 1124, modulators 1126, a receiver 1128, a memory device 1130, a processor device 1132, and a bus 1134. The LED packets 1122 can be in groups. Each group of LED packets can correspond to a pixel, where each LED packet can be a sub-pixel of a pixel of the active display 1102.

Together, the group of LED packets forms the pixel for the active display 1102. In some examples, each LED packet is a tri-color LED packet with LEDs corresponding to each of the red primary color, the green primary color, and the blue primary color. In some example, each LED packet also includes a second green LED.

LED drivers 1124 can control each LED in the LED packets 1122. The modulators 1126 can each include modulation circuitry to control the LEDs to modulate light outputted by the LEDs. In some examples, the modulators 1126 can modulate the light outputted by the LEDs via pulse-width modulation. The receiver 1128 can receive data, such as LED attributes, from other components of the system 1100, such as the server device 1104. In some examples, the receiver 1128 can receive attributes during presentation of visual media to an audience that is present in the theatre.

The memory device 1130 can be a non-transitory computer-readable medium for storing data and instructions that can be executed by the processor device 1132 to perform operations. The bus 1134 can allow data and instructions to be communicated among the components of the active display 1102.

The memory device 1130 can store intensity values 1138 received from the server device 1104. The memory device 1130 can include an intensity engine 1136 that can be executed by the processor device 1132 to determine a control signal for the LED drivers 1124 and modulators 1126 to control the intensity of light outputted by the LEDs, using the intensity values 1138. By controlling the intensity of light outputted by each LED, a group of LED packets forming a pixel can output light in a color gamut of a color space for the active display 1102 that is different than the color gamut that can be achieved by each LED individually. The color space may be DCI-P3, Rec. 2020, or another color space suitable for displaying a visual presentation, such as a movie, to an audience. In some examples, the memory device 1130 can also include an attenuation value for each LED that can be used by the active display to control the intensity of primary light outputted by each LED.

EXAMPLES

As used below, any reference to a series of examples is to be understood as a reference to each of those examples disjunctively (e.g., "Examples 1 to 4" is to be understood as "Examples 1, 2, 3, or 4").

Example 1 is an active display for displaying a visual media presentation to an audience, the active display comprising: a group of LED packets forming a pixel on the active display, each LED packet of the group of LED packets representing a sub-pixel of the pixel and including a plurality of LEDs that comprise a red LED, a green LED, and a blue LED, wherein a respective LED of the plurality of LEDs is associated with an intensity value to control an intensity of primary light outputted by the respective LED such that the group of LED packets is configured to output light in a color gamut of a color space for the active display, wherein each LED packet of the group of LED packets, individually, is configured to output light in a subset color gamut of the color gamut for the active display.

Example 2 is the active display of example(s) 1, wherein the group of LED packets comprise at least a first LED packet and a second LED packet, wherein the first LED packet includes a first LED corresponding to a first primary color and the second LED packet includes a second LED corresponding to a second primary color, the first primary color and the second primary color being outside of a usable primary range, the first LED and the second LED being configured to be used in combination to create a synthesized primary color having a chromaticity within the usable primary range.

Example 3 is the active display of any of example(s) 1 to 2, wherein each LED of the plurality of LEDs is associated with an attenuation value to control the intensity of primary light outputted by the LED.

Example 4 is the active display of example(s) 3, wherein attenuation values for the plurality of LEDs are selected such that the intensity of light outputted by the group of LED packets is uniform.

Example 5 is the active display of example(s) 3, wherein the attenuation values for the plurality of LEDs are switchable between a first set of attenuation values corresponding to a first color space and a second set of attenuation values corresponding to a second color space to switch between the first color space and the second color space for the display.

Example 6 is the active display of example(s) 5, wherein the active display is configured to switch between the first color space and the second color space based on image data of the visual media presentation.

Example 7 is the active display of any of example(s) 1 to 6, wherein the intensity value associated with the respective LED of the plurality of LEDs is different than intensity values associated with other LEDs of the plurality of LEDs.

Example 8 is the active display of any of example(s) 1 to 7, wherein the green LED is a first green LED, wherein the plurality of LEDs further comprise a second green LED.

Example 9 is the active display of any of example(s) 1 to 8, wherein the color space is a wide color gamut that is DCI-P3 or Rec. 2020.

Example 10 is the active display of any of example(s) 1 to 9, further comprising: a non-transitory computer-readable medium configured to store attenuation values for use with the plurality of LEDs; and modulation circuitry configured to control each LED of the plurality of LEDs to modulate light outputted by the plurality of LEDs.

Example 11 is the active display of example(s) 10, wherein the modulation circuitry is configured to modulate the light outputted by the plurality of LEDs by pulse-width modulation.

Example 12 is the active display of any of example(s) 1 to 10, further comprising: a receiver configured to receive intensity values for the plurality of LEDs from a server device during presentation of the visual media presentation to the audience.

Example 13 is the active display of any of example(s) 1 to 12, wherein the intensity values are configured to be determined using data captured by a camera during a calibration process.

Example 14 is the active display of any of example(s) 1 to 13, wherein the active display is positioned in an immersive theatre environment.

Example 15 is the active display of any of example(s) 1 to 14, wherein the LED packets of the group of LED packets are selectable from a plurality of bins, each bin of the plurality of bins being associated with a different chromaticity range than other bins of the plurality of bins.

Example 16 is a method comprising: forming a pixel on an active display by a group of LED packets that represent sub-pixels of the pixel and that include a plurality of LEDs that comprise a red LED, a green LED, and a blue LED; controlling an intensity of primary light outputted by each LED of the plurality of LEDs using an intensity value for each LED of the plurality of LEDs; and outputting light, by the group of LED packets for displaying a visual media presentation to an audience, in a color gamut of a color space for the active display and outputting, by each LED packet of the group of LED packets individually, in the color gamut of a subset of the color space.

Example 17 is the method of example(s) 16, further comprising: controlling the intensity of primary light outputted by each LED using an attenuation value for each LED of the plurality of LEDs.

Example 18 is the method of example(s) 16, wherein the intensity value associated with each LED of the plurality of LEDs is different than intensity values associated with other LEDs of the plurality of LEDs.

Example 19 is the method of example(s) 16, wherein the green LED is a first green LED, wherein the plurality of LEDs further comprise a second green LED.

Example 20 is the method of example(s) 16, wherein the color space is DCI-P3 or Rec. 2020.

Example 21 is the method of example(s) 16, further comprising: storing attenuation values for use with the plurality of LEDs; and modulating light outputted by the plurality of LEDs using modulation circuitry that controls each LED of the plurality of LEDs.

Example 22 is the method of example(s) 21, wherein modulating the light outputted by the plurality of LEDs includes modulating the light by pulse-width modulation.

Example 23 is the method of example(s) 16, further comprising: receiving intensity values for the plurality of LEDs from a server device during presentation of the visual media presentation to the audience.

Example 24 is the method of example(s) 16, further comprising: capturing, by a camera, at least two images of light displayed by the pixel, the at least two images comprising a least one image captured using a color filter with the camera and at least one other image captured without using the color filter; determining the intensity values using the at least two images.

Example 25 is the method of example(s) 16, wherein the LED packets of the group of LED packets are selectable from a plurality of bins, each bin of the plurality of bins being associated with a different chromaticity range than other bins of the plurality of bins.

Certain aspects and features are disclosed in the form of examples but the intention is not that this should be limiting in any way but rather that any modifications and additions that a person skilled in the art could propose should be included in the scope. While the present subject matter has been described in detail with respect to specific aspects thereof, it will be appreciated that those skilled in the art, upon attaining an understanding of the foregoing, may readily produce alterations to, variations of, and equivalents to such aspects. Any aspects or examples may be combined with any other aspects or examples. Accordingly, it should be understood that the present disclosure has been presented for purposes of example rather than limitation, and does not preclude inclusion of such modifications, variations, or additions to the present subject matter as would be readily apparent to one of ordinary skill in the art.

What is claimed is:

1. An active display for displaying a visual media presentation to an audience, the active display comprising:

a group of LED packets forming a pixel on the active display, each LED packet of the group of LED packets representing a sub-pixel of the pixel and including a plurality of LEDs that comprise a red LED, a green LED, and a blue LED, wherein a respective LED of the plurality of LEDs is associated with an intensity value to control an intensity of primary light outputted by the respective LED such that the group of LED packets is configured to output light in a color gamut of a color space for the active display, wherein each LED packet of the group of LED packets, individually, is configured to output light in a subset color gamut of the color gamut for the active display.

2. The active display of claim 1, wherein the group of LED packets comprise at least a first LED packet and a second LED packet, wherein the first LED packet includes a first LED corresponding to a first primary color and the second LED packet includes a second LED corresponding to a second primary color, the first primary color and the second primary color being outside of a usable primary range, the first LED and the second LED being configured to be used in combination to create a synthesized primary color having a chromaticity within the usable primary range.

3. The active display of claim 1, wherein each LED of the plurality of LEDs is associated with an attenuation value to control the intensity of primary light outputted by the LED.

4. The active display of claim 3, wherein attenuation values for the plurality of LEDs are selected such that the intensity of primary light outputted by the group of LED packets is uniform.

5. The active display of claim 3, wherein attenuation values for the plurality of LEDs are switchable between a first set of attenuation values corresponding to a first color space and a second set of attenuation values corresponding to a second color space to switch between the first color space and the second color space for the active display.

6. The active display of claim 5, wherein the active display is configured to switch between the first color space and the second color space based on image data of the visual media presentation.

7. The active display of claim 1, wherein the intensity value associated with the respective LED of the plurality of LEDs is different than intensity values associated with other LEDs of the plurality of LEDs.

8. The active display of claim 1, wherein the green LED is a first green LED, wherein the plurality of LEDs further comprise a second green LED.

9. The active display of claim 1, wherein the color space is a wide color gamut that is DCI-P3 or Rec. 2020.

10. The active display of claim 1, further comprising:

a non-transitory computer-readable medium configured to store attenuation values for use with the plurality of LEDs; and modulation circuitry configured to control each LED of the plurality of LEDs to modulate light outputted by the plurality of LEDs.

11. The active display of claim 10, wherein the modulation circuitry is configured to modulate the light outputted by the plurality of LEDs by pulse-width modulation.

12. The active display of claim 1, further comprising:

a receiver configured to receive intensity values for the plurality of LEDs from a server device during presentation of the visual media presentation to the audience.

13. The active display of any of claim 12, wherein the intensity values are configured to be determined using data captured by a camera during a calibration process.

14. The active display of claim 1, wherein the active display is positioned in an immersive theatre environment.

15. The active display of any of claim 1, wherein LED packets of the group of LED packets are selectable from a plurality of bins, each bin of the plurality of bins being associated with a different chromaticity range than other bins of the plurality of bins.

16. A method comprising:

forming a pixel on an active display by a group of LED packets that represent sub-pixels of the pixel and that include a plurality of LEDs that comprise a red LED, a green LED, and a blue LED;

controlling an intensity of primary light outputted by each LED of the plurality of LEDs using an intensity value for each LED of the plurality of LEDs; and outputting light, by the group of LED packets for displaying a visual media presentation to an audience, in a color gamut of a color space for the active display and outputting, by each LED packet of the group of LED packets individually, in the color gamut of a subset of the color space.

17. The method of claim 16, further comprising:

controlling the intensity of primary light outputted by each LED using an attenuation value for each LED of the plurality of LEDs.

18. The method of claim 16, wherein the intensity value associated with each LED of the plurality of LEDs is different than intensity values associated with other LEDs of the plurality of LEDs.

19. The method of claim 16, wherein the green LED is a first green LED, wherein the plurality of LEDs further comprise a second green LED.

20. The method of claim 16, wherein the color space is DCI-P3 or Rec. 2020.

21. The method of claim 16, further comprising:

storing attenuation values for use with the plurality of LEDs; and modulating light outputted by the plurality of LEDs using modulation circuitry that controls each LED of the plurality of LEDs.

22. The method of claim 21, wherein modulating the light outputted by the plurality of LEDs includes modulating the light by pulse-width modulation.

23. The method of claim 16, further comprising:

receiving intensity values for the plurality of LEDs from a server device during presentation of the visual media presentation to the audience.

24. The method of claim 23, further comprising:

capturing, by a camera, at least two images of light displayed by the pixel, the at least two images comprising a least one image captured using a color filter with the camera and at least one other image captured without using the color filter;

determining the intensity values using the at least two images.

25. The method of claim 16, wherein LED packets of the group of LED packets are selectable from a plurality of bins, each bin of the plurality of bins being associated with a different chromaticity range than other bins of the plurality of bins.

* * * * *